US011619113B1

(12) United States Patent
Griffin et al.

(10) Patent No.: US 11,619,113 B1
(45) Date of Patent: Apr. 4, 2023

(54) WELL-FOULING ABATEMENT SYSTEM AND METHOD FOR WELLS

(71) Applicant: S.S. Papadopulos & Associates, Inc., Rockville, MD (US)

(72) Inventors: Shelly Mae Griffin, Gladstone, MO (US); Benjamin Brett Petersen, Gladstone, MO (US)

(73) Assignee: S.S. Papadopulos & Associates, Inc., Rockville, MD (US)

( * ) Notice: Subject to any disclaimer, the term of this patent is extended or adjusted under 35 U.S.C. 154(b) by 0 days.

(21) Appl. No.: 17/354,813

(22) Filed: Jun. 22, 2021

(51) Int. Cl.
*E21B 37/06* (2006.01)
*B08B 17/00* (2006.01)

(52) U.S. Cl.
CPC ..... *E21B 37/06* (2013.01); *B08B 17/00* (2013.01)

(58) Field of Classification Search
None
See application file for complete search history.

(56) References Cited

U.S. PATENT DOCUMENTS 5,190,108 A * 3/1993 Mansuy ..... E21B 43/121 166/305.1
7,546,901 B1 6/2009 Hall et al.
10,036,509 B2 7/2018 Markham et al.
10,829,298 B2 11/2020 Young et al.
2009/0020286 A1* 1/2009 Johnson ..... E21B 41/0042 166/292
2014/0221256 A1* 8/2014 Holtsclaw ..... C09K 8/86 507/225

OTHER PUBLICATIONS

USGS Circular 1292, "Volatile Organic Compounds in the Nation's Ground Water and Drinking-Water Supply Wells", Glossary, Apr. 2006, pp. 1-112, available at https://pubs.usgs.gov/circ/circ1292/.

* cited by examiner

*Primary Examiner* — Andrew Sue-Ako
(74) *Attorney, Agent, or Firm* — Hunton Andrews Kurth LLP

(57) ABSTRACT

Exemplary embodiments seek to eliminate or reduce fouling enabled by atmospheric oxygen entering the airspace of the well column. An inerting gas is used to flush atmospheric oxygen out of the well airspace. Once atmospheric air in the well gas-column has been replaced with an inerting gas, the well is sealed and pressurized with the inerting gas. The introduction of atmospheric oxygen back into the system through leaks is overcome by keeping a small, positive pressure-differential between the well-column gas pressure and the atmosphere. Results, as described herein, have shown the removal of atmospheric oxygen from the system can greatly reduce, or eliminate, both chemical and biological fouling as well as reduce or eliminate the need for well cleaning treatments.

20 Claims, 10 Drawing Sheets

900

902

904

906

WELL-FOULING ABATEMENT SYSTEM AND METHOD FOR WELLS

FIELD OF THE INVENTION

This application relates to the field of water wells and methods used to remedy problematic conditions in such wells including chemical precipitation, biological fouling, and/or scaling, which can diminish the functioning of wells and water quality. Specifically, exemplary embodiments generally relate to a system and method that provides fouling abatement for water wells, although methods have applicability to other types of wells experiencing such fouling.

BACKGROUND

Fouling of wells is a common problem in nearly all types of wells, not limited to but including residential, public, commercial, and remediation wells. Well fouling can generally be described as the precipitation or deposition of material within or immediately adjacent to a well resulting from one or a combination of physical, chemical, or biological processes. The build-up of material from this precipitation or deposition, within or around the well, may detrimentally affect the intended performance of the well. Non-limiting examples of detrimental effects include damaging of pumps, reducing the pumping capacity of an extraction well, clogging of effluent piping, and affecting the quality or appearance of water produced from a drinking water well.

Various strategies have been employed to alleviate well fouling. Methods employed include: 1) the introduction of chlorine into the well water to mitigate biological growth; 2) the introduction of an acid into the well that has the effect of keeping oxidizable minerals in their dissolved phase; and/or 3) periodic cleaning/flushing of the well, filter pack, and/or surrounding aquifer with brushes, chemicals, and/or heat to remove the build-up of fouling materials. However, these methods address only specific fouling problems and may create undesirable side effects. (1) For example, chlorine can lessen biological growth but can simultaneously enhance oxidative fouling. In addition, creation of undesirable chemical compounds such as disinfection by-products can occur during the use of chlorine in a well. Chlorine and its by-products create concerns for the surrounding environment and receptor's use. (2) Acids decrease the pH of well water and keep in solution minerals that would normally precipitate in the presence of oxygen. Acids, however, generally do not stop all fouling, can potentially damage well components, and must be continually replenished as water moves through a well. (3) Cleaning treatments and/or flushing of a well aim to remove deposited materials that are inhibiting proper function of the well, but these treatments are typically expensive, do not address the root cause of the fouling and scaling, generates waste requiring proper disposal, and requires turning off pumping wells during treatment.

These and other drawbacks exist.

SUMMARY OF EXEMPLARY EMBODIMENTS

An exemplary embodiment includes a system having a supply of inerting gas; a gas supply line fluidly coupled to the supply of inerting gas that is fluidly coupled to a well through an air-tight seal, the gas supply line extending through the air-tight seal and into the well and terminating at a point above a fluid level in the well, wherein the supply of inerting gas is configured to displace existing atmospheric air in an air column of the well above the liquid level in the well and thereby create an anoxic environment that inhibits biological fouling, chemical precipitation, and scaling in the well; and a regulator positioned in-line on the gas supply line and configured to supply the inerting gas on demand to the well, the regulator being further configured to maintain a pressure of the inerting gas, in the well, greater than atmospheric pressure.

Another exemplary embodiment includes a method of supplying an inerting gas, through a regulator, to an air column of a well; purging the air column, using the inerting gas, to remove existing gas in the air column; measuring an oxygen content of purged gas from the air column; lowering the oxygen content in the air column to a level that inhibits biological fouling, chemical precipitate, and scaling; and maintaining a pressure, greater than atmospheric pressure in the air column, of the inerting gas to maintain the oxygen level at a level that inhibits biological fouling, chemical precipitation, and scaling within the well.

These and other advantages will be described more fully in the following detailed description.

BRIEF DESCRIPTION OF THE DRAWINGS

In order to facilitate a fuller understanding of the various embodiments, reference is made to the attached drawings. The drawings should not be construed as limiting the various embodiments but are intended only to illustrate different aspects and embodiments.

DETAILED DESCRIPTION

Figure 1:
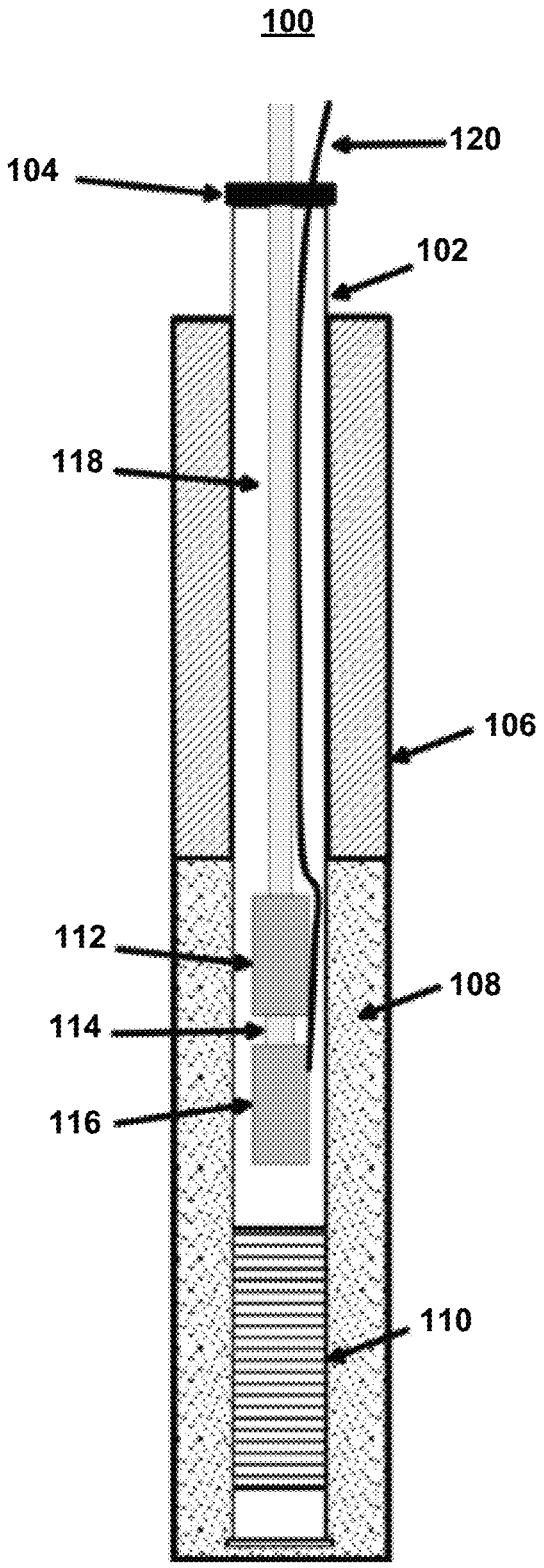
FIG. 1 depicts a common design of an extraction well.

The following description is intended to convey an understanding of exemplary embodiments by providing specific embodiments and details. It is understood, however, that various embodiments are not limited to these specific embodiments and details, which are exemplary only. It is further understood that one possessing ordinary skill in the art, in light of known systems and methods, would appreciate the use of various embodiments for its intended purposes and benefits in any number of alternative embodiments, depending upon specific design and other needs.

The following descriptions provide different configurations and features according to exemplary embodiments.

While certain nomenclature and types of applications/hardware are described, other names and application/hardware usage is possible, and the nomenclature provided is done so by way of non-limiting examples only. Further, while particular embodiments are described, it should be appreciated that the features and functions of each embodiment may be combined in any combination as is within the capability of one of ordinary skill in the art. The figures provide additional exemplary details regarding the various embodiments. It should also be appreciated that these exemplary embodiments are provided as non-limiting examples only.

Various exemplary methods are provided by way of example herein. These methods are exemplary as there are a variety of ways to carry out methods according to the present disclosure. The methods depicted and described can be executed or otherwise performed by one or a combination of various systems and modules. Each block shown in the methods represents one or more processes, decisions, methods or subroutines carried out in the exemplary method, and these processes, decisions, methods or subroutines are not necessarily carried out in the specific order outlined in the methods, nor is each of them required.

Exemplary embodiments provide a system and method that prevents well-fouling from the precipitation, growth, or deposition of material within or immediately adjacent to an extraction well resulting from physical, chemical, and/or biological processes. As a threshold matter, it should be noted that exemplary embodiments are not directed at the prevention of fouling from deposition of particulate material such as clay or silt. Some of the most common chemical and biological well-fouling processes require the presence of dissolved oxygen to occur. Non-limiting examples include: 1) the precipitation of iron or iron rich deposits within well-water resulting from the conversion of dissolved ferrous iron, Fe2+, to ferric iron, Fe3+, 2) the precipitation of dissolved manganese and manganese compounds, such as $MnHCO_3$+, to a precipitate, such as $MnCO_3$, and 3) the accumulation of organic material such as biologically created structures, growth, and biological detritus. Thus, exemplary embodiments address and solve the deficiencies of existing methods and systems in preventing fouling (such as by physical, chemical, and/or biological processes) in extraction wells for ground water as described in the background section above.

Exemplary embodiments differ from existing gas blanketing systems in application, purpose, and chemical process by which they mitigate fouling of extraction wells. For example, gas blanketing systems may be used to reduce corrosion in hydrocarbon storage tanks or as a safety measure to reduce the risk of explosions in storage tanks containing combustible materials. These systems are not used with ground water as in exemplary embodiments. Further, these systems are not used to mitigate or prevent fouling of pumps and equipment through creation and maintenance of atmospheric conditions that prevent chemical deposition of oxidated materials and the growth of bacteria. Creating a non-explosive or inflammable atmosphere within the extraction well is not a goal of exemplary embodiments. Exemplary embodiments do not rely upon the addition of any additives, such as, but not limited to, Volatile Corrosion Inhibitors (VCIs), with the inerting gas. Finally, while exemplary embodiments are directed to ground water extraction wells, other embodiments may have application in other types of wells where fouling, as described herein, is prevalent and causes an impact to well function.

Two common sources of dissolved oxygen in a well are ground water (any water present in the subsurface) and the atmospheric air. Of the two sources, the atmospheric air is typically the primary source of dissolved oxygen because much groundwater is anoxic due to the activity of subsurface biological and chemical reactions that consume available oxygen. Anoxic water does not contain sufficient levels of oxygen to allow most biological fouling. Anoxic ground water also limits or stops chemical oxidation processes that require oxygen within ground water. Through the construction and use of a well, the introduction of atmospheric oxygen may raise dissolved oxygen concentrations in well water high enough for physical and chemical changes and biological fouling to occur from the interaction of the atmospheric oxygen and the well water.

Exemplary embodiments seek to eliminate or reduce fouling enabled by atmospheric oxygen (i.e., $O_2$) entering the airspace of the well column. A well airspace inerting gas, in the sense that it does not contain significant $O_2$ and will slow or stop problematic conditions in the well environment caused or contributed to by oxygen, is used to flush atmospheric oxygen out of the well airspace. Non-limiting examples of such well airspace inerting gases are carbon dioxide ($CO_2$) and nitrogen ($N_2$). Other gas, or mixtures thereof may be used. Once low oxygen conditions in the wellhead airspace have been achieved, the well is sealed and pressurized with the inerting gas. The introduction of atmospheric oxygen back into the system through leaks is overcome by keeping a small, positive pressure-differential between the well column and the atmosphere. A pilot study, as described below, demonstrated the removal of $O_2$ from the system and the replacement with an inerting gas can greatly reduce or eliminate both chemical and biological fouling as well as reduce or eliminate the need for well cleaning treatments. The end-result is improved well performance and decreased long-term maintenance costs associated with biological fouling, and chemical precipitation, and/or scaling.

FIG. 1 depicts a conventional extraction well 100. In exemplary embodiments, extraction well 100 may be a ground water well. The extraction well 100 has a well casing 102, a wellhead cap/seal 104, an annular seal 106, a filter pack 108, and a screen 110. Within the well casing 102 is a pump 112 having an intake 114 and a motor 116. The pump 112 is fluidly connected to discharge piping 118. Electrical and control wiring 120 may run into the well 100 through the wellhead 104 to allow for power to the pump 112, as well as control over the pump 112. The pump 112 is configured to move fluid (e.g., water) out of the well to an exterior location, drawing fluid (e.g., water) through the screen 110 into the intake 114 and exhausting through the discharge piping 118.

Figure 2:
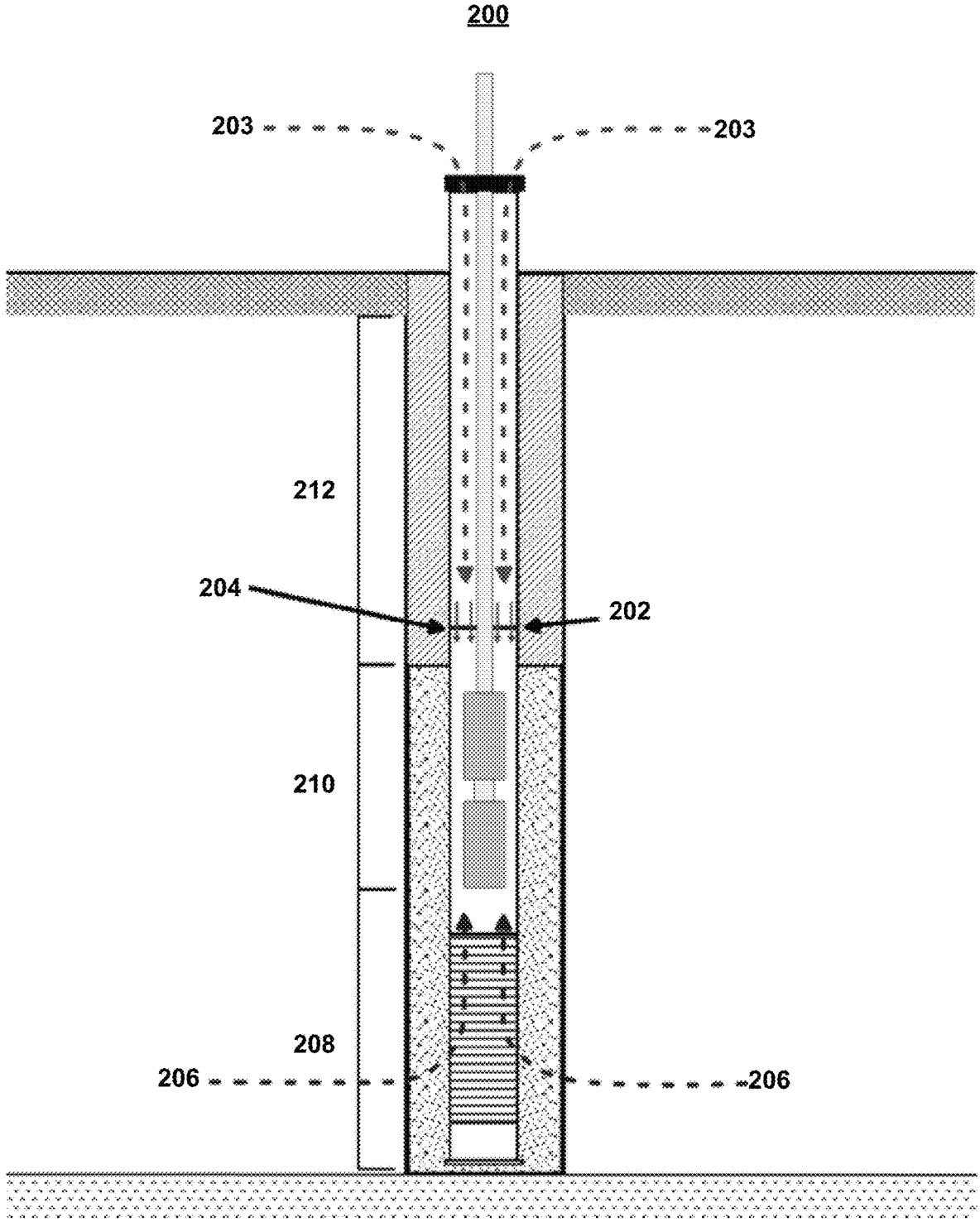
FIG. 2 depicts potential oxygen sources and fouling zones within a typical extraction well.

FIG. 2 depicts potential oxygen sources and fouling zones within a typical extraction well. The extraction well may be configured as depicted in FIG. 1. The well 200 may have a water level 202. At this air-fluid interface, movement of oxygen may occur from the atmosphere (203) into the water 202 as dissolved oxygen (at 204). Lower in the well, below this air-fluid interface, anoxic ground water 206 mixes upward. This set of conditions sets up three zones within the well 200 (starting at the bottom, or lower level, of the well 200 and going upwards to the well-head): an anoxic zone 208, a mixing zone 210, and an oxic zone 212.

In the oxic zone 212, oxygen from the airspace moves into the water column as dissolved oxygen, the levels of dissolved oxygen in the system are the highest in this region. Near the bottom of the oxic zone 212, oxygen moves into the water at the air-water boundary. The mixing zone-oxic zone boundary begins where water is no longer in direct connection with air. In the mixing zone, the dissolved oxygen levels in the water are sufficient to allow biological growth to occur and chemical precipitate and scaling to occur. The oxic zone-mixing zone boundary is likely to occur just below the air/water interface.

In the mixing zone 210, biological growth occurs, and dissolved oxygen reacts with and oxidizes dissolved Fe2+ to create insoluble Fe3+ minerals. The anoxic zone begins where oxygen levels are low enough that chemical oxidation reactions and biological growth is limited or cannot occur. The anoxic boundary limiting oxidation reactions may not occur at the same depth as the cessation of biological fouling. The minimum oxygen content that creates anoxic conditions is different depending on water conditions; however, the US Geological Survey defines anoxic ground water as ground water with no dissolved oxygen or with dissolved oxygen concentrations of less than 0.5 milligrams per liter (see USGS Circular 1292, *Volatile Organic Compounds in the Nation's Ground Water and Drinking-Water Supply Wells*, Glossary, April 2006, available at pubs.usgs.gov).

Figure 3:
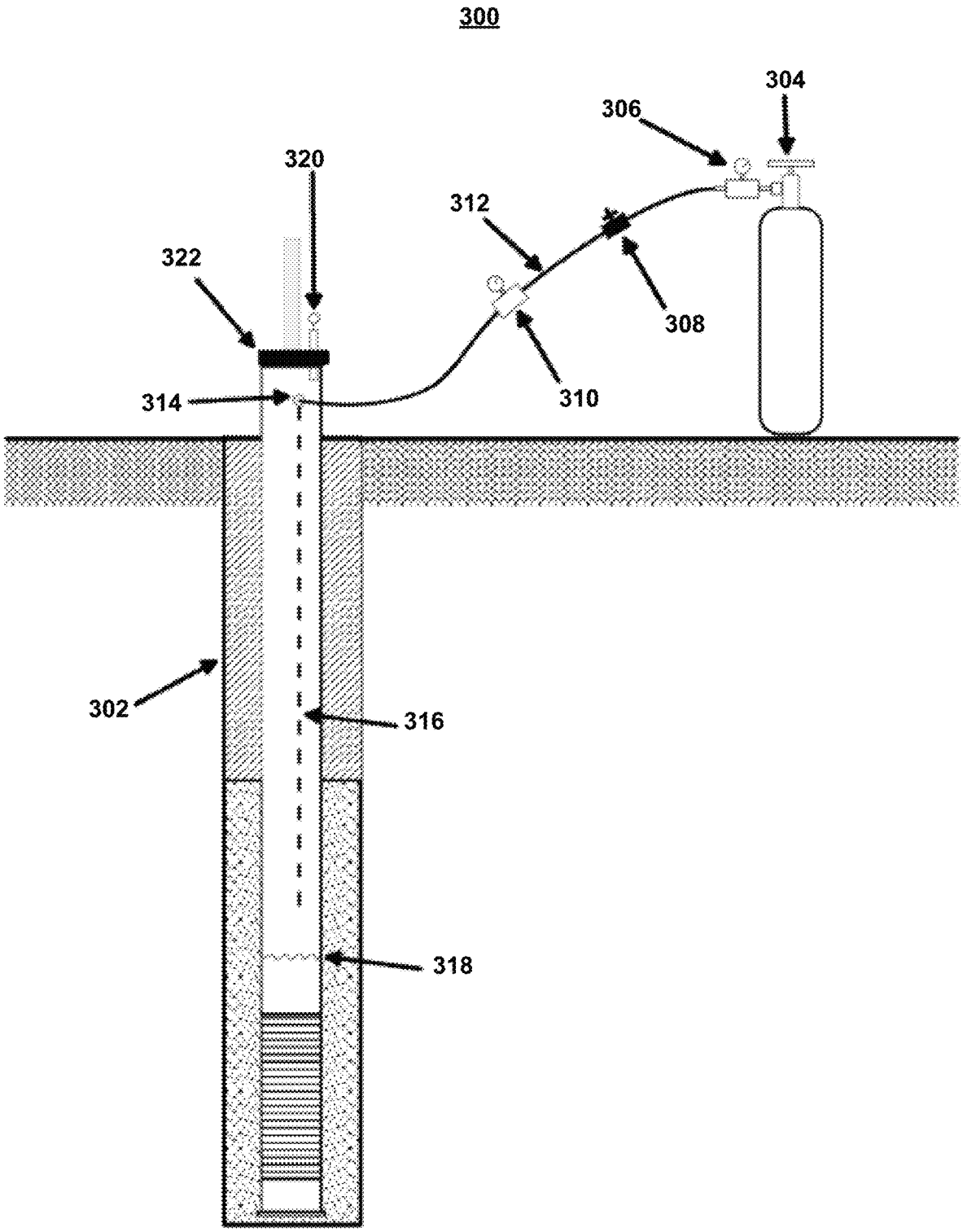
FIG. 3 depicts a system according to exemplary embodiments.

FIG. 3 depicts a system according to exemplary embodiments. Exemplary embodiments include: 1) an inerting gas distribution system to supply gas to an extraction well(s) (302) through a gas supply tank 304, a regulator 306, a shut-off valve 308, an in-line pressure gauge 310, and a gas supply line 312, which is coupled into the well at a connection 314 and 2) proper controls and procedures to remove and maintain an atmospheric-oxygen free airspace inside the well. The gas supply line 312 may be made of any suitable piping material such as plastic, metal, or combinations thereof. For example, the gas supply line 312 in exemplary embodiments may be polyethylene. The gas supply line 312 inside the well may continue inside the well casing to a point above the fluid level (318) in the well (as shown at 316). The well 302 may further include a pressure relief valve and oxygen sensor 320 and an air-tight wellhead seal 322. It should be appreciated that an air-tight seal at 322 is important to exemplary embodiments in order to maintain a gas pressure greater than atmospheric air pressure at the well location. Further, it should be appreciated that other equipment may be required such as deemed necessary by site, local, state, and/or federal authorities.

It should be appreciated that other components are not depicted, such as conveyance piping, tubing fittings, additional regulators, manifolds, pressure gauges, pressure-relief valves, shut-off valves, and other equipment to control gas delivery. The components used in exemplary embodiments may include: 40 cubic foot (cf) to 300 cf compressed inerting-gas cylinder(s), a dual-stage regulator with a maximum inlet pressure of 3000 pounds per square inch gauge (psig) that supplies inerting gas in the 0 to 2 (psig) range at 0.5 or greater gallons of gas per minute, 4 cylinder manifold with individual tank shutoff valves, compressed cylinder mounting bracket(s), brass or stainless steel needle valves, brass or stainless steel ball valves, brass or stainless steel compression fittings, brass or stainless steel barb fittings, brass or stainless steel check valve, brass or stainless steel bulkhead NPT to compression fittings, brass or stainless steel "T" compression fittings, rubber or silicon washers, in-line moisture filter with automatic release valve, brass or stainless steel adjustable 0.5 to 5 psig pressure relief valve, 0 to 3 psig pressure gauge, ¼ inch through ½ inch braided poly ethylene tubing, 1-inch MDPE yellow gas piping, 1 to 3 cubic foot reinforced inflatable bag or bladder, an inerting-gas generator such as $N_2$ gas that generates gas at the rate required to replace gas lost through leaks or pressure releases. It should be appreciated that this listing of components is exemplary and non-limiting. As appreciated by one of ordinary skill in the art, other similar components may be used.

The distribution system for the inerting gas (such as that depicted in FIG. 3) may include a compressed-gas cylinder or tank 304. In exemplary embodiments, the inerting gas may be $CO_2$ or $N_2$. Other inerting gases may be used, such as the noble gases Argon (Ar), Helium (He), and/or any combination of these and the exemplary embodiments. In various embodiments, the inerting gas may be a mixture of gases. In some embodiments, any oxygen-free gas may be used because a non-explosive atmosphere is not being maintained (i.e., the gas does not have to be "inert" as understood by one of ordinary skill in the art). Further, although a single gas cylinder 304 is depicted, it should be appreciated that more than one gas cylinder may be used. For example, two or more gas cylinders may be coupled to a manifold and regulator in parallel or sequence. It should be appreciated that a singular gas supply system, composed of one or more cylinders or tanks, may supply multiple ground water wells. Such a configuration may enable the system to operate longer between gas cylinder replacement or refill. It should be appreciated that in place of gas cylinders or tanks, a gas purifier or generator could be used to supply the system.

Gas may flow from the cylinder into the well through the regulator 306 and the gas supply line 312. The regulator 306 may control the flowrate and pressure. The gas may fluidly move into the well casing through an air-tight seal at connection 314. The gas supply line 312 may be extended down into the well (316) but remain above the top of the fluid level 318.

According to exemplary embodiments, the regulator provides a method to maintain positive air pressure inside the well. The regulator may supply inerting gas only when a minimum positive pressure is reached. For example, if water levels inside the well drop, causing the gas in the well to expand, air pressures can drop to vacuum pressure. With the regulator set to supply gas when minimum positive pressure is reached, gas can be injected into the well as water levels drop to maintain positive gas pressure, stopping the intake of atmospheric oxygen. Conversely, water levels may rise in the well, causing the gas in the well to compress and air pressures to rise. If pressures inside the well are equal to or greater than the supply pressure of the regulator, gas flow into the well from the regulator stops. If pressures in the well are greater than the relief setting of the pressure relief valve, gas from inside the well will be released through the pressure relief valve.

In some embodiments, a baffle or similar expandable compartment may be attached to the system. The additional compartment will expand and fill with gas from the well air-column when a critical airspace pressure is reached within the well. The expansion of the compartment reduces the gas pressure buildup inside the well. When gas air-space pressures drops below the minimum pressure required to keep the expandable compartment open, gas will flow from the compartment back into the well air-column. The use of the expandable compartment may be used in an embodiment that maintains a closed system when a gas release system may not be appropriate.

Figure 4:
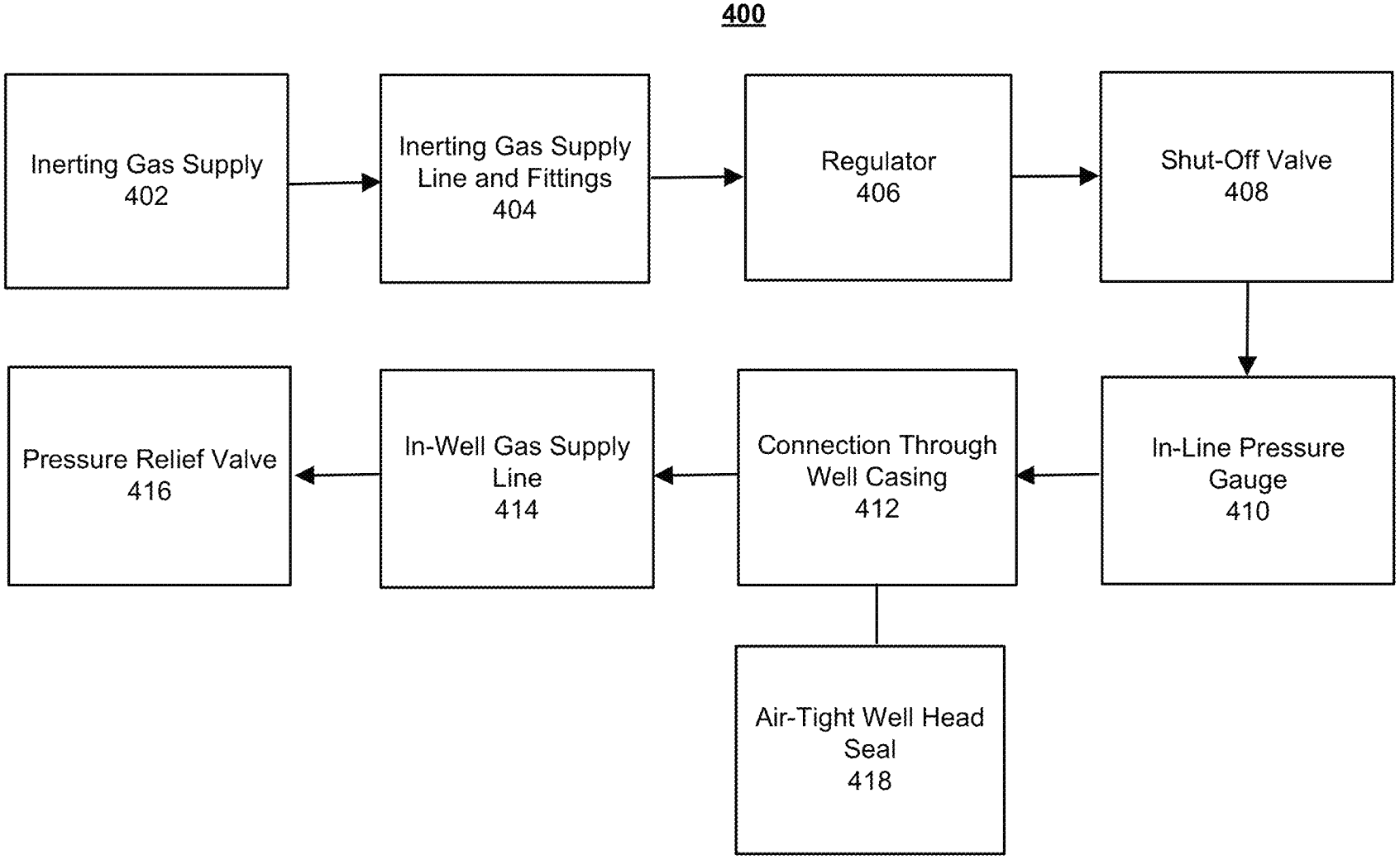
FIG. 4 depicts the components according to exemplary embodiments.

FIG. 4 depicts the components and their interaction according to exemplary embodiments. Inerting gas supply 402 may provide an on-demand supply of inerting gas. The gas supply may be an individual tank, two or more tanks connected through a manifold, and/or an inerting gas generator. The tanks may contain compressed gas. The gas supply 402 may be coupled to an inerting gas supply line and fittings 404. These are fittings and piping/tubing that connect the valves and parts of the system together and convey gas between the well and the components described herein. Exemplary materials may include polyethylene, copper, brass, steel, and/or other suitable materials. The inerting gas supply line and fittings 404, while shown at one location in FIG. 4, run from the gas supply 402 to the connection through well casing, with the various other components positioned in-line or connected to the gas supply line. Regulator 406 may reduce the output pressure from the gas supply to a low positive pressure greater than atmospheric pressure (e.g., atmospheric pressure being approximately 14.7 psi (psi absolute or psia) at sea level). According to exemplary embodiments, the pressure may be between 0.1 and 1 psi (i.e., psi gauge or psig). This positive pressure may prevent the entry of atmospheric gas into the well in order to maintain the inerting gas blanket created by exemplary embodiment. The regulator may be of the dual-stage type when used with a high-pressure gas supply or under appropriate conditions.

Shut-off valve 408 may be a ball, needle, gate, globe, or other valve type. The valve may be used to isolate the gas supply from the well. This may allow for the gas supply to be swapped out or changed without losing gas in the well (i.e., pressure may be maintained) or introducing atmospheric gas (i.e., containing oxygen) into the well through the system. In-line pressure gauge 410 may be used to measure in-well pressure for monitoring of pressure variation.

Connection through well-casing 412 may be a fitting that creates a gas-tight seal to allow the supply gas to pass into the well through the well casing. In-well gas supply line 414 may be an extension of the supply line 404 inside the well that delivers the supply gas into the well casing. In exemplary embodiments, the in-well gas supply line 414 may extend to and terminate above the maximum liquid level in the well. This may allow for proper flushing of atmospheric gas (i.e., $O_2$) from the well. According to exemplary embodiments, the supply line should not extend into the liquid, as that may increase the pressure required to inject gas into the well.

Pressure relief valve 416 may allow for relief of excess pressures above the relief valve set-point. In exemplary embodiments, relief pressures may be set at 5 psig or less. In exemplary embodiments, the relief valve should have a manual release to allow for expulsion of gas during purging of the well during introduction of the inerting gas. An oxygen sensor may be attached to a fitting connected to the pressure relief valve to allow for monitoring of the oxygen level of expelled gas, particularly during the initial purging of the well. Additional piping or tubing may be used to direct purged air volume away from workers or the work area. The pressure relief valve may be located external to the well (see, e.g., FIG. 7).

Air-tight well head seal 418 is a seal that may allow for discharge piping, electrical, and pressure relief valve to pass through the well head and maintain a gas tight seal. According to exemplary embodiments, the seal may be a commercially available well head seal with a rubber gasket between two plates. The two plates may compress the gasket, which may then expand to seal the casing and penetrating components. It should be appreciated that this ordering and interaction of components is exemplary and non-limiting.

It should be appreciated that the sequence of components of FIG. 4 is exemplary and the components (e.g., regulator 406, shut-off valve 408, in-line pressure gauge 410) may be arranged in a different sequence or order between the inert gas supply 402 and the well casing connection 412.

Figure 5:
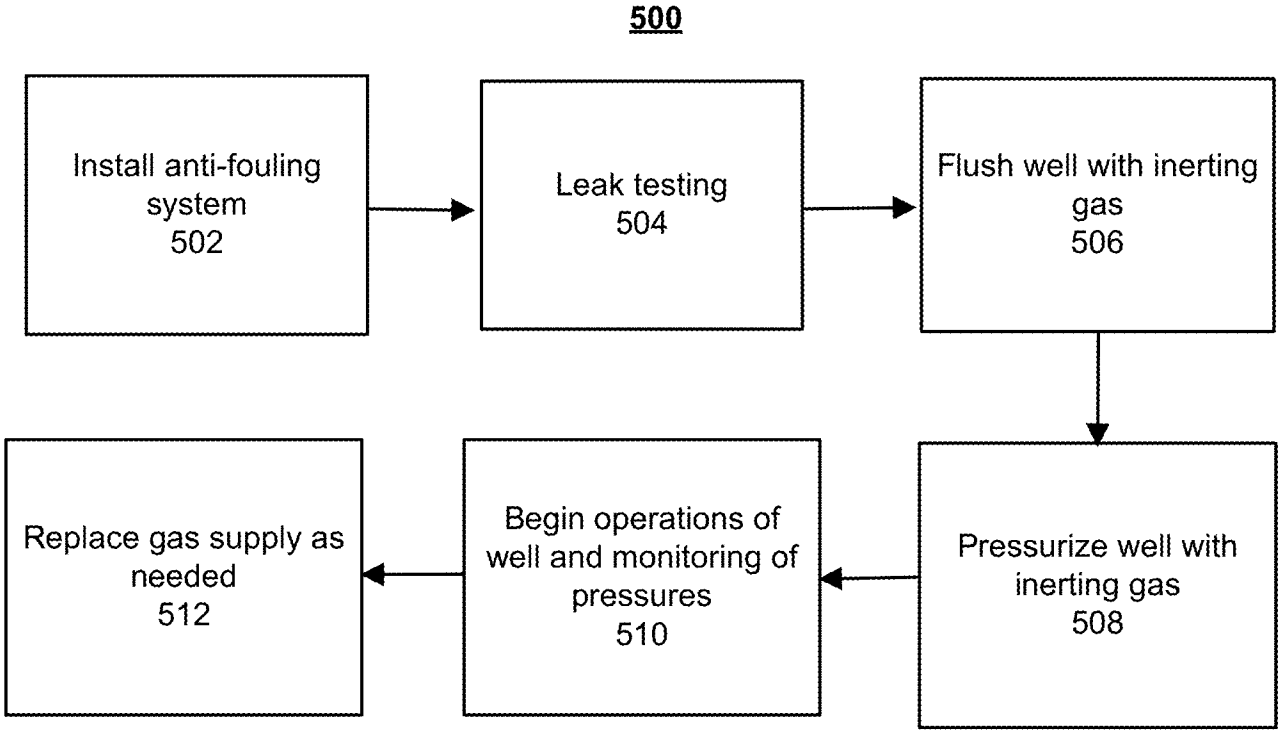
FIG. 5 depicts a method according to exemplary embodiments.

FIG. 5 depicts a method 500 according to exemplary embodiments.

First, at step 502, a system, such as, but not limited to, that depicted in FIG. 3, is installed at an extraction well (such as, but not limited to, a well as depicted in FIG. 1).

Next, at step 504, the assembled system may be leak tested and sealed where required. The well may be turned off (if it is currently in operation). The well-head fittings, as well as other supply components, may be tightened and sealed. Gas, such as, but not limited to, the inerting supply gas, may then be injected into the well such that in-well pressure reaches at least a maximum pressure expected during operation. A common method for leak testing involves pressurizing the system and applying soapy water on all connections. Bubbles may form at locations where gas is escaping; these locations should be sealed, or resealed, as appropriate. A leak check is important because stopping or minimizing leaks can help to minimize the usage rate of the inerting gas.

Next, at step 506, once the system has been constructed and leak tested, the well is flushed with inerting gas. The inerting gas may be injected into the well at a small positive pressure (such as 1 psig) through the supply line(s). The gas may enter the well column near the top of or near the surface of the maximum liquid (e.g., water) level. As the inerting gas enters the bottom of the airspace above the fluid level, gas may be manually released from the pressure relief valve. The oxygen level ($O_2$) of the expelled gas may be monitored. An oxygen sensor may be used to monitor the oxygen level. For example, the oxygen content of expelled air can be measured as a percentage of background atmospheric content (i.e., where a 100% reading equals 20.5% atmospheric oxygen content). The flushing of the air column with inerting gas may continue until the oxygen level has at least dropped to a level low enough to inhibit the growth of most aerobic biologic growth in the well water. Removal of atmospheric oxygen from the well column airspace may reduce or stop the mixing of oxygen into the well water column and reduce the overall concentrations of dissolved oxygen in the well water. According to exemplary embodiments, the level of oxygen to inhibit this biological growth, as well as inhibit chemical reactions, may be approximately 5% of dissolved oxygen content (or less) in water (specifically, 5.41% or less). However, it should be appreciated that the exact level of oxygen, or other growth/reaction limiting element, may be site- and nuisance-dependent. Thus, for example, other embodiments may require a different level of oxygen content to achieve the desired results.

At step 508, the well is pressurized with inert gas. The gas supply regulator may be set to the desired pressure (e.g., between 0.1 and 1 psig). The head space is allowed to pressurize until the regulator outlet pressure equals the air-column pressure.

Next, at step 510, well operations may be commenced and pressures can be monitored. The extraction well may be placed back in operation. The pressures in the well column may be monitored by observing the in-line pressure gauge. The regulator outlet pressure may be adjusted if a higher or lower pressure is desired or required. For example, fluid level changes in the well (e.g., the water level rising or falling) may cause the pressure to increase (if the fluid level rises) or decrease (if the fluid level falls). The regulator can allow for appropriate gas flow to compensate for this pressure change. Gas can be manually released from the well through the pressure relief valve. The oxygen level of gas released from the well may be monitored to ensure anoxic conditions are maintained. Periodic sampling of the well atmosphere may be conducted.

At step 512, the inerting gas supply can be replaced. If the supply tank (or equipment) run out of gas, it can be replaced or the cylinder(s) refilled. If the inerting gas is not readily supplied to the well, fluctuating water levels, temperatures, and other factors can create vacuum (less than atmospheric) pressures inside the well. Vacuum pressure can pull in atmospheric oxygen through small leaks in the system and allow fouling to occur. The regulator used to maintain the necessary gas pressure may be as described above with respect to FIG. 4. The shutoff valve may be used to isolate the system to enable the gas supply to be removed and replaced.

Figure 6:
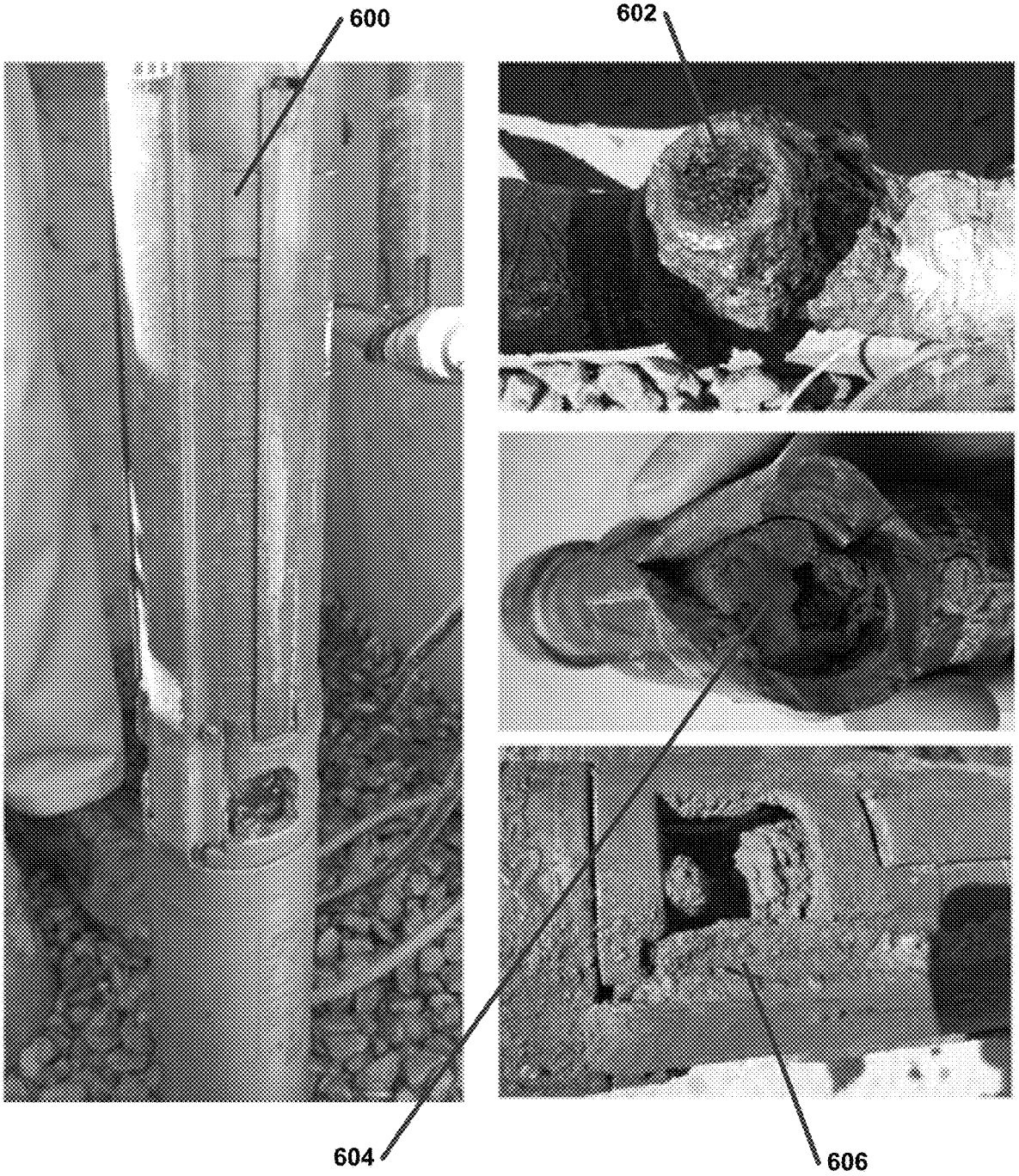
FIG. 6 shows images of the pre-treatment condition of pumps in test wells.

Pre-treatment conditions of the pumps and piping are shown in FIG. 6 at the images 600, 602, 604, and 606. As can be seen from the images of FIG. 6, the pumps and piping were heavily scaled with precipitate and significantly biologically fouled, decreasing the operational efficiency of each component, and as a result, the overall efficiency of the well. Further details of FIG. 6 and what is shown is provided below.

Figure 7:
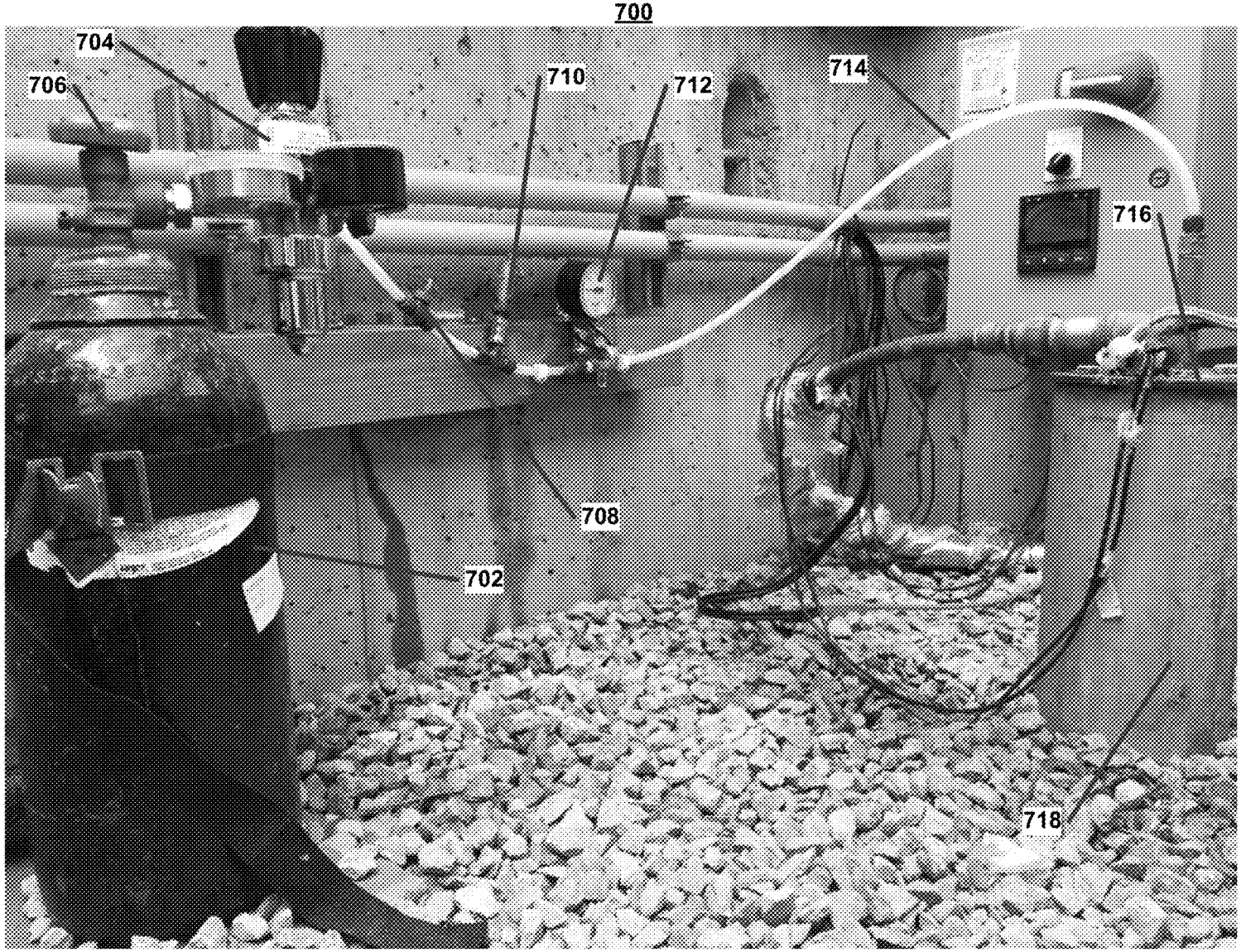
FIG. 7 shows an image of the test set-up for the pilot study.

FIG. 7 shows an image of an exemplary test set-up 700 that was used for the pilot study. Inerting gas under high pressure (up to 2500 psig) may flow from the compressed gas cylinder 702 into the dual-stage regulator 704 by opening the gas tank stem valve 706 attached to the gas cylinder 702. The gas cylinder 702 may be placed on a stable surface and secured, such as by using a strap. The gas cylinder 702 may be in a location that is protected from the elements. In various embodiments, the use of such a compressed gas is subject to various safety regulations. Gas pressures may be reduced by the dual-stage regulator 704 to a low pressure in the range of 0 to 2 psig. Exit pressures may be set using an adjustment knob on the top of the regulator 704. The low-pressure gas may pass through the tubing 714 (which was ⅜-inch polyethylene supply line) and a series of additional appurtenances. The needle valve 708 may be used to shut off flow to and from the well and gas cylinder. Excess pressures may be relieved by the 10 psig the pressure-relief valve 710. In-well pressures may be monitored using a 0 to 3 psig range, in-line pressure gauge 712. Inerting gas may pass through the sanitary seal 716 into the extraction well's 718 air column (inside of the casing shown at 718). Not shown in the image of FIG. 7 is the in-well gas line extension (e.g., such as shown in FIG. 3 at 316, which may deliver inerting gas above the top of the maximum height of the water column).

The configuration depicted in FIG. 7 differs slightly from that of FIG. 3. The two key differences are the pressure relief valve was moved so it penetrates through the sanitary seal and the tubing enters the well through the well casing via a bulkhead fitting. As described above, FIG. 7 represents an initial test configuration.

Figure 8A:
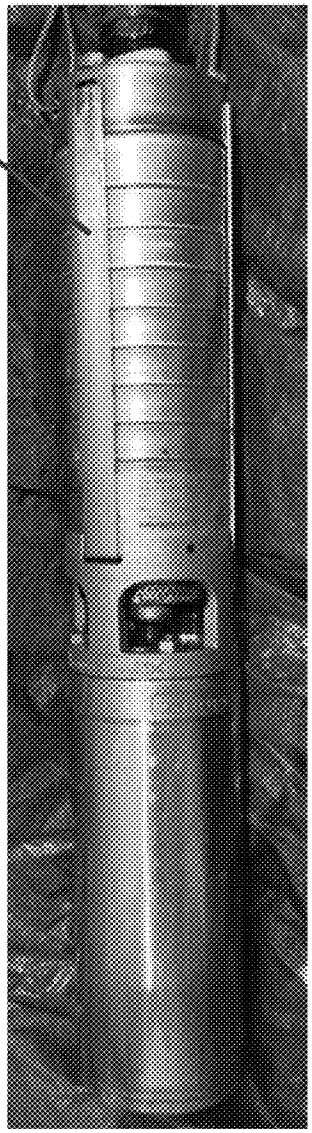
FIGS. 8A-8C show images of the pump-motor assemblages from test wells after 14 months at the end of the pilot-study period.
Figure 8B:
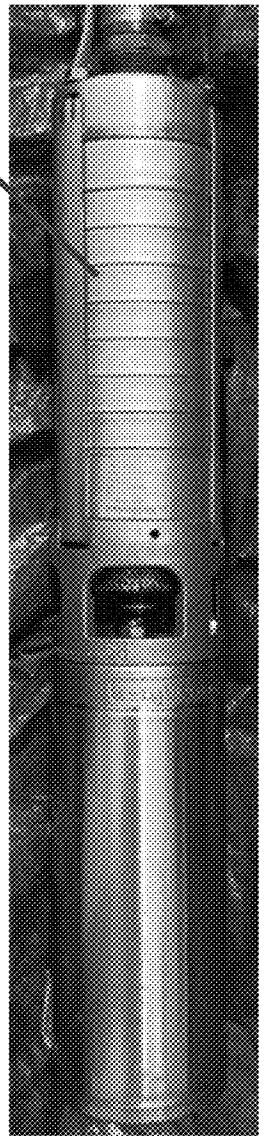
Figure 8C:
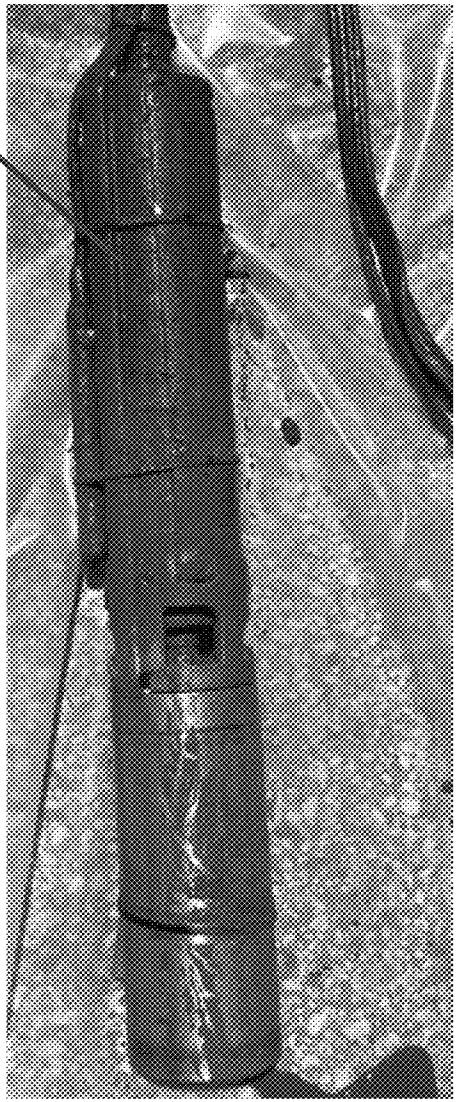

FIGS. 8A-8B at images 802 and 804, respectively, shows images of the pump-motor assemblage of the gas-treated test wells after 14 months at the end of the pilot study. FIG. 8C at image 806 shows the pump-motor assemblage of chlorine treated well 235 after 14 months at the end of the pilot-testing period. Further description of FIGS. 8A-8C is provided below in the Example.

Figure 9:
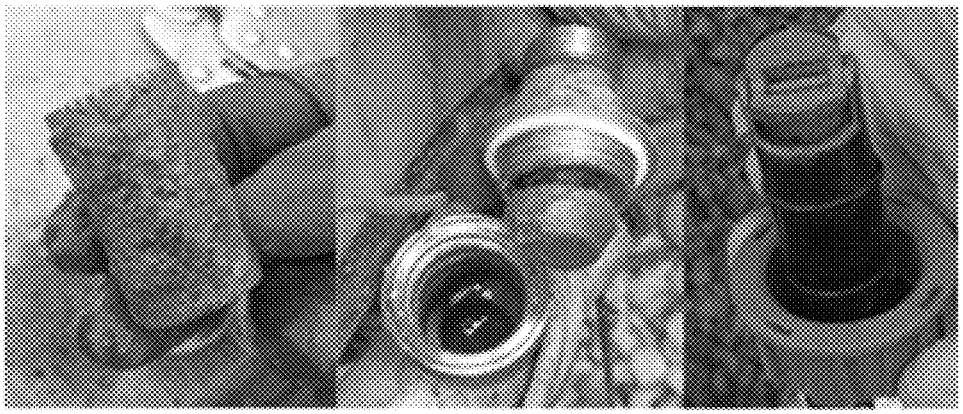
FIG. 9 shows images of components at various points in the pilot study.
Figure 9:
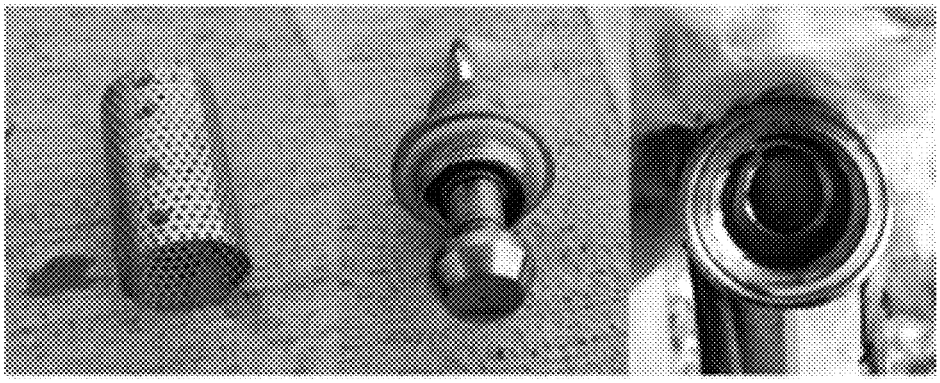
Figure 9:
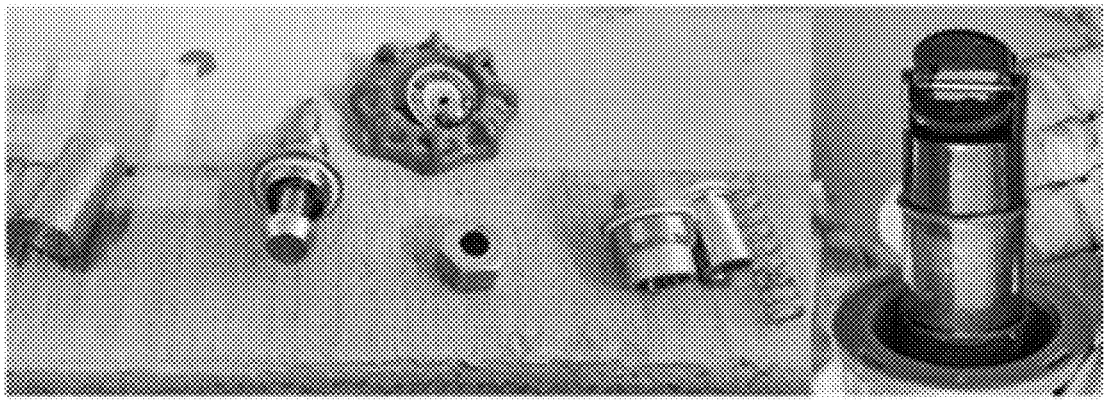
Figure 9:
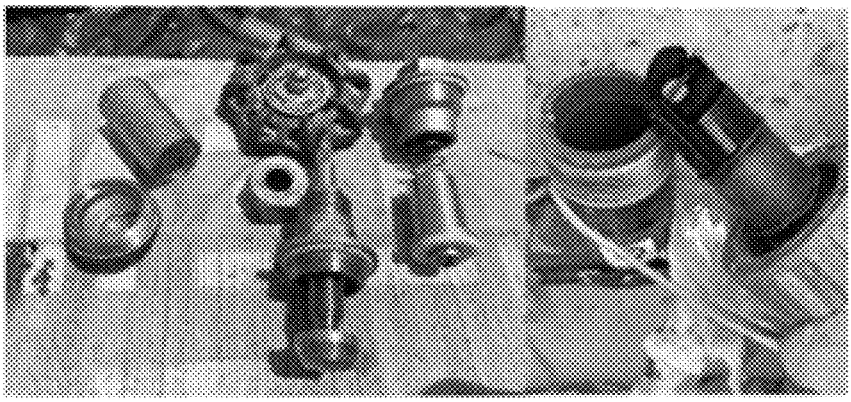

FIG. 9 shows images of components in effluent piping from one of the pilot study well's (TEW-09) at various points during the study. Photographs in 900 show, from left to right, the strainer, globe valve, and flow meter with clear signs of fouling. These components were pre-gas treatment and the parts shown were cleaned on a weekly basis. Photographs in 902 show, from left to right, the strainer, globe vale, and globe valve seat with no signs of scaling or fouling after 3 weeks of gas treatment with no manual or additional cleaning performed. Photographs in 904 show, from left to right, the strainer, globe valve components, check valve, and flow meter with no signs of fouling after 6 months of gas treatment with no manual or additional cleaning performed. Photographs in 906 show, from right to left, the strainer, globe valve, check valve, and flow meter after 14 months at the end of the pilot-testing period with no manual or additional cleaning performed.

Figure 10:
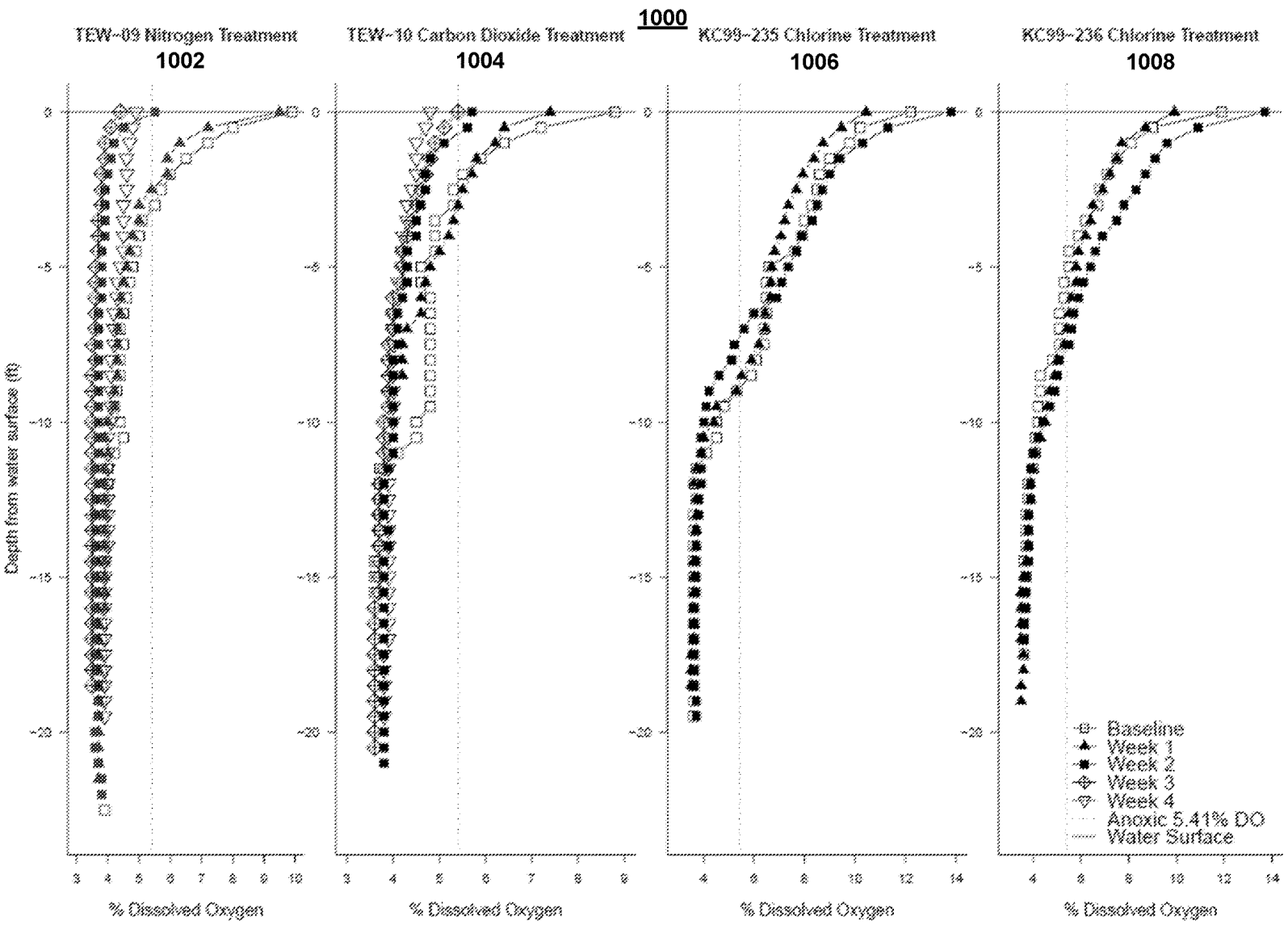
FIG. 10 shows graphs comparing dissolved oxygen levels in water between the inerting-gas test wells and chlorine treated wells.

FIG. 10 at 1000 shows four graphs (1002, 1004, 1006, and 1008) comparing dissolved oxygen levels between the test wells and chlorine treated wells. Measurements are referenced from the top of water, or 0 feet. Negative values indicate the depth below the top of the water during the measurement period. Anoxic conditions (0.5 mg/L or 5.41% Dissolved Oxygen (D.O.)) are indicated by measurements to the left of the vertical anoxic line on each plot. Gas treated wells (TEW-09 (1002) and TEW-10 (1004)) are shown on the left, and chlorine treated wells (KC99-235 (1006) and KC99-236 (1008)) are shown on the right.

It should be appreciated that the aforementioned embodiments are not limited to wells are constructed with water discharge piping passing through an air-tight well head seal. Similar designs may be implemented for wells that discharge through pit-less adapters or other, and will be apparent to those familiar with the art.

Example

Results from the pilot study to determine the efficacy of exemplary embodiments will now be described.

Testing the efficacy of inerting gas blanketing as an anti-fouling method in water wells was performed at an environmental remediation site where the extraction wells had a history of severe chemical precipitate and biological fouling. Heat and chemical well-cleaning treatments as well as chlorine tablets were historically used to address the fouling in these wells. The well-cleaning treatments were effective at cleaning out fouling debris, but biologic growth could be observed in the wells only weeks after treatment in some wells. Chlorine was effective at reducing or eliminating biofouling; however, the scaling and precipitation continued and was likely enhanced by the oxidative potential of chlorine. The fouling continued in chlorine treated wells, where it clogged piping, inhibited proper well-functioning, and did not eliminate the need for more costly acid-cleaning treatments. Two of the extraction wells, TEW-09 and TEW-10, were chosen to test the inerting gas anti-fouling system as described herein. FIG. 6 depicts pre-treatment condition of the pumps and piping for these wells. Image 600 shows the TEW-10 pump-intake-motor combination covered in typical iron precipitates and biological fouling. Image 602 shows fouled water being flushed out of the piping through the flow meter port. Image 604 shows broken piping from the TEW-09 vault. This piping had completely clogged due to the precipitation of iron minerals and biologic detritus. Finally, image 606 shows fouling covering the water intake of TEW-09 that was inhibiting the well's performance.

The initial test was conceived to determine the feasibility and utility of maintaining an anoxic in-well environment, thus reducing the possibility for non-biological as well as biological fouling. Two additional nearby extraction wells, KC99-235 and KC99-236 were chosen as controls and treated with chlorine over the pilot study period.

Prior to the implementation of the pilot study, wells TEW-09, TEW-10, KC99-235, and KC99-236 were rehabilitated. The rehabilitation included manual cleaning of pump and motors, air lifting of sediments, and acid treatment of the wells and extraction well parts.

Inerting gas delivery systems, specifically those shown in FIG. 7 at 700, were built inside the vaults that housed TEW-09 and TEW-10. FIG. 7 depicts the TEW-09 system. A size 40 $N_2$ (nitrogen) tank was used in TEW-09 and a 201b $CO_2$ (carbon dioxide) tank was used in TEW-10. The supply lines extended through the sanitary seal at the well head down to approximately 14 feet below the top of casing but above the water surface in the well. Electrical and communication wires exiting through the sanitary seal were sealed with silicone caulking. All connections, feedthroughs, and fittings were leak checked using the soapy water method and resealed when required. Before inerting the airspace in TEW-09 and TEW-10, baseline water dissolved oxygen (D.O.) measurements were collected and plotted on FIG. 10.

To begin the study, wells TEW-09 and TEW-10 were flushed with inerting gas, sealed, and pressurized. During this testing period, gas pressure, pumping rates, and D.O. levels were measured; results are summarized in FIG. 10 and Tables 1 and 2 (included below). Pumping rates during the test period were monitored and adjusted in response to precipitation events and in-well gas pressures.

TABLE 2

Dissolved oxygen measurements during the pilot study (note: bolded cells indicate non-anoxic conditions).

| Percent Dissolved Oxygen | | | | | |
|---|---|---|---|---|---|
| TEW-09 | | | | | |
| Depth from water surface (feet) | Baseline Apr. 17, 2019 | Week 1 May 2, 2019 | Week 2 May 8, 2019 | Week 3 May 14, 2019 | Week 4 May 22, 2019 |
| 0 | **9.9** | **9.5** | **5.5** | 4.4 | 4.9 |
| −0.5 | **8** | **7.2** | 4.5 | 4.1 | 4.8 |
| −1 | **7.2** | **6.3** | 4.2 | 3.9 | 4.7 |
| −1.5 | **6.5** | **5.9** | 4.1 | 3.9 | 4.6 |
| −2 | **6** | **5.9** | 4 | 3.8 | 4.6 |
| −2.5 | **5.7** | 5.4 | 3.9 | 3.8 | 4.6 |
| −3 | **5.5** | 5 | 3.9 | 3.8 | 4.5 |
| −3.5 | 5.1 | 5 | 3.9 | 3.7 | 4.5 |
| −4 | 5 | 4.8 | 3.9 | 3.7 | 4.5 |
| −4.5 | 4.9 | 4.7 | 3.8 | 3.7 | 4.5 |
| −5 | 4.8 | 4.6 | 3.8 | 3.6 | 4.4 |
| −5.5 | 4.7 | 4.5 | 3.8 | 3.6 | 4.3 |
| −6 | 4.6 | 4.4 | 3.8 | 3.6 | 4.3 |
| −6.5 | 4.5 | 4.4 | 3.7 | 3.6 | 4.2 |
| −7 | 4.4 | 4.3 | 3.7 | 3.6 | 4.2 |

TABLE 1

Summary of inerting-gas tank pressures, well pumping-rate, regulator outlet pressure, and in-line gas pressures in gas treatment wells TEW-09 and TEW-10.

| Date | Tank Pressure (psig) | Pumping-rate (gpm) | Outlet Pressure (psig) | Inline Pressure (psig) |
|---|---|---|---|---|
| TEW-09 Pressure and Pumping-Rate Measurements | | | | |
| Apr. 24, 2019 | 2075 | | | |
| Apr. 30, 2019 | 2000 | 2.5 | | 0.2 |
| May 1, 2019 | 2000 | | | 0.5 |
| May 3, 2019 | 1860 | 2.7 | 0.1 | 0.05 |
| May 6, 2019 | 1875 | | 0.1 | 0.05 |
| May 7, 2019 | 1900 | 2.6 | 0.15 | 0 |
| May 8, 2019 | 1760 | 2.6 | 0.18 | 0.05 |
| May 10, 2019 | 1700 | 2.6 | 0.05 | 0.05 |
| May 14, 2019 | 1600 | 2.4 | 0.3 | 0.2 |
| May 20, 2019 | 1425 | 2 | 0.55 | 0.45 |
| May 21, 2019 | 1350 | 2.7 | 0.82 | 0.7 |
| May 21, 2019 | | 3.2 | 0.76 | |
| May 22, 2019 | 1340 | 3.5 | 0.67 | 0.55 |
| May 24, 2019 | 1200 | 3.5 | 0.36 | 0.24 |
| May 29, 2019 | 1175 | 3.5 | 0.35 | 0.2 |
| TEW-10 - Pressure and Pumping-Rate Measurements | | | | |
| Apr. 17, 2019 | 750 | 2.3 | | |
| Apr. 29, 2019 | 700 | | 0.1 | |
| Apr. 30, 2019 | 640 | 1.65 | | 0.2 |
| May 1, 2019 | 650 | 1.6 | | 0.4 |
| May 3, 2019 | 660 | 1.3 | 0.1 | 0.1 |
| May 6, 2019 | 705 | | 0.1 | 0.05 |
| May 8, 2019 | 750 | 1.2 | 0.37 | 0.37 |
| May 14, 2019 | 700 | 1.8 | 0.25 | 0.2 |
| May 20, 2019 | 700 | 1.5 | 0.44 | 0.43 |
| May 21, 2019 | 600 | 1.5 | 0.6 | 0.58 |
| May 21, 2019 | | 1.6 | 0.6 | |
| May 22, 2019 | 650 | 1.5 | 0.54 | 0.52 |
| May 24, 2019 | 780 | 1.6 | 0.35 | 0.32 |
| May 29, 2019 | 800 | 1.7 | 0.3 | 0.3 |

note:

*tank pressures within $C0_2$ tanks are not indicative of the remaining gas within the tank, as $C0_2$ may be present as both a liquid and a gas.

TABLE 2-continued

Dissolved oxygen measurements during the pilot study (note: bolded cells indicate non-anoxic conditions).

Percent Dissolved Oxygen

| | | | | | |
|---|---|---|---|---|---|
| −7.5 | 4.5 | 4.3 | 3.7 | 3.5 | 4.2 |
| −8 | 4.4 | 4.3 | 3.7 | 3.6 | 4.1 |
| −8.5 | 4.4 | 4.3 | 3.7 | 3.5 | 4.1 |
| −9 | 4.3 | 4.2 | 3.7 | 3.5 | 4.1 |
| −9.5 | 4.2 | 4.2 | 3.7 | 3.5 | 4.1 |
| −10 | 4.4 | 4 | 3.7 | 3.5 | 4.1 |
| −10.5 | 4.5 | 3.9 | 3.7 | 3.5 | 4 |
| −11 | 4.2 | 4 | 3.7 | 3.5 | 4 |
| −11.5 | 4 | 3.9 | 3.6 | 3.5 | 4 |
| −12 | 4 | 3.9 | 3.7 | 3.5 | 4 |
| −12.5 | 3.9 | 3.9 | 3.6 | 3.5 | 4 |
| −13 | 3.9 | 3.9 | 3.6 | 3.5 | 4 |
| −13.5 | 3.9 | 3.9 | 3.6 | 3.5 | 4 |
| −14 | 3.9 | 3.9 | 3.6 | 3.5 | 4 |
| −14.5 | 3.9 | 3.9 | 3.6 | 3.5 | 3.9 |
| −15 | 3.8 | 3.9 | 3.6 | 3.5 | 3.9 |
| −15.5 | 3.8 | 3.9 | 3.6 | 3.5 | 3.9 |
| −16 | 3.8 | 3.9 | 3.6 | 3.5 | 3.9 |
| −16.5 | 3.8 | 3.7 | 3.6 | 3.5 | 3.9 |
| −17 | 3.8 | 3.7 | 3.6 | 3.5 | 3.9 |
| −17.5 | 3.8 | 3.7 | 3.6 | 3.5 | 3.9 |
| −18 | 3.8 | 3.7 | 3.6 | 3.5 | 3.9 |
| −18.5 | 3.8 | 3.7 | 3.7 | 3.5 | 3.9 |
| −19 | 3.8 | 3.7 | 3.7 | | 3.9 |
| −19.5 | | 3.7 | 3.7 | | 3.9 |
| −20 | | 3.7 | 3.6 | | |
| −20.5 | | 3.7 | 3.6 | | |
| −21 | | 3.7 | 3.7 | | |
| −21.5 | | 3.7 | 3.8 | | |
| −22 | | | 3.8 | | |
| −22.5 | 3.9 | | | | |

TEW-10

| Depth from water surface (feet) | Baseline Apr. 17, 2019 | Week 1 May 2, 2019 | Week 2 May 8, 2019 | Week 3 May 14, 2019 | Week 4 May 22, 2019 |
|---|---|---|---|---|---|
| 0 | **8.8** | **7.4** | **5.7** | 5.4 | 4.8 |
| −0.5 | **7.2** | **6.4** | **5.6** | 5.1 | 4.7 |
| −1 | **6.4** | **6.2** | 5.1 | 4.9 | 4.5 |
| −1.5 | **5.9** | **5.8** | 4.8 | 4.8 | 4.5 |
| −2 | **5.5** | **5.7** | 4.7 | 4.7 | 4.5 |
| −2.5 | 5.3 | **5.5** | 4.7 | 4.6 | 4.4 |
| −3 | 5.3 | 5.4 | 4.6 | 4.5 | 4.3 |
| −3.5 | 4.9 | 5.3 | 4.5 | 4.4 | 4.3 |
| −4 | 4.9 | 5.2 | 4.5 | 4.3 | 4.2 |
| −4.5 | 4.9 | 5 | 4.3 | 4.2 | 4.2 |
| −5 | 4.6 | 4.8 | 4.3 | 4.2 | 4.2 |
| −5.5 | 4.6 | 4.7 | 4.3 | 4.2 | 4.1 |
| −6 | 4.8 | 4.6 | 4.2 | 4 | 4.1 |
| −6.5 | 4.8 | 4.6 | 4.1 | 4 | 4 |
| −7 | 4.8 | 4.3 | 4.1 | 4 | 4 |
| −7.5 | 4.8 | 4.2 | 4.1 | 3.9 | 4 |
| −8 | 4.8 | 4.2 | 4 | 3.9 | 4 |
| −8.5 | 4.8 | 4.2 | 4 | 3.9 | 4 |
| −9 | 4.8 | | 4 | 3.9 | 4 |
| −9.5 | 4.8 | | 4 | 3.9 | 4 |
| −10 | 4.5 | | 4 | 3.8 | 4 |
| −10.5 | 4.5 | | 4 | 3.8 | 3.9 |
| −11 | 4.1 | | 4 | 3.8 | 3.9 |
| −11.5 | 3.7 | | 3.9 | 3.8 | 3.9 |
| −12 | 3.7 | | 3.8 | 3.7 | 3.9 |
| −12.5 | 3.7 | | 3.8 | 3.7 | 3.9 |
| −13 | 3.7 | | 3.8 | 3.7 | 3.9 |
| −13.5 | 3.7 | | 3.9 | 3.7 | 3.9 |
| −14 | 3.7 | | 3.9 | 3.7 | 3.9 |
| −14.5 | 3.6 | | 3.8 | 3.7 | 3.9 |
| −15 | 3.6 | | 3.8 | 3.7 | 3.9 |
| −15.5 | 3.6 | | 3.8 | 3.7 | 3.9 |
| −16 | | | 3.8 | 3.6 | 3.9 |
| −16.5 | | | 3.8 | 3.6 | 3.9 |
| −17 | | | 3.8 | 3.6 | 3.9 |

TABLE 2-continued

Dissolved oxygen measurements during the pilot study (note: bolded cells indicate non-anoxic conditions).

Percent Dissolved Oxygen

| | | | | |
|---|---|---|---|---|
| −17.5 | | 3.8 | 3.6 | 3.8 |
| −18 | | 3.8 | 3.6 | 3.8 |
| −18.5 | | 3.8 | 3.6 | 3.8 |
| −19 | | 3.8 | 3.6 | 3.8 |
| −19.5 | | 3.8 | 3.6 | 3.8 |
| −20 | | 3.8 | 3.6 | |
| −20.5 | | 3.8 | 3.6 | |
| −21 | | 3.8 | | |

| Depth (feet) | KC99-235 | | | KC99-236 | | |
|---|---|---|---|---|---|---|
| from water surface | Baseline Apr. 16, 2019 | Week 1 May 3, 2019 | Week 4 May 22, 2019 | Baseline Apr. 16, 2019 | Week 1 May 3, 2019 | Week 4 May 22, 2019 |
| 0.0 | **12.2** | **11.9** | **10.4** | **9.9** | **13.8** | **13.7** |
| 0.5 | **10.2** | **9.0** | **9.5** | **8.7** | **11.3** | **10.9** |
| 1.0 | **9.8** | **8.1** | **8.7** | **7.7** | **10.3** | **9.6** |
| 1.5 | **9.0** | **7.5** | **8.4** | **7.5** | **9.4** | **9.1** |
| 2.0 | **8.6** | **7.1** | **7.9** | **7.2** | **9.0** | **8.7** |
| 2.5 | **8.5** | **6.8** | **7.7** | **6.9** | **8.7** | **8.3** |
| 3.0 | **8.3** | **6.7** | **7.4** | **6.5** | **8.5** | **7.8** |
| 3.5 | **8.0** | **6.2** | **7.2** | **6.4** | **8.3** | **7.5** |
| 4.0 | **7.9** | **5.9** | **7.1** | **6.2** | **7.9** | **6.9** |
| 4.5 | **7.6** | **5.5** | **6.8** | **5.9** | **7.7** | **6.6** |
| 5.0 | **6.6** | **5.5** | **6.7** | **5.8** | **7.4** | **6.4** |
| 5.5 | **6.5** | 5.3 | **6.7** | **5.8** | **7.1** | **6.1** |
| 6.0 | **6.5** | 5.3 | **6.6** | **5.6** | **6.9** | **5.9** |
| 6.5 | **6.5** | 5.1 | **6.5** | **5.5** | **6.0** | **5.7** |
| 7.0 | **6.4** | 5.1 | **6.5** | 5.4 | **5.6** | **5.6** |
| 7.5 | **6.4** | 5.1 | **6.2** | 5.3 | 5.2 | **5.5** |
| 8.0 | **6.1** | 4.8 | **5.9** | 5.0 | 5.1 | 5.1 |
| 8.5 | **5.9** | 4.3 | **5.5** | 4.9 | 4.6 | 5.0 |
| 9.0 | 5.3 | 4.3 | 5.3 | 4.7 | 4.2 | 4.9 |
| 9.5 | 4.8 | 4.2 | 4.5 | 4.6 | 4.1 | 4.7 |
| 10.0 | 4.5 | 4.2 | 4.4 | 4.5 | 4.0 | 4.4 |
| 10.5 | 4.5 | 4.1 | 4.0 | 4.3 | 3.9 | 4.2 |
| 11.0 | 4.1 | 4.1 | 3.9 | 4.1 | 3.9 | 4.0 |
| 11.5 | 3.7 | 4.0 | 3.7 | 4.0 | 3.9 | 3.9 |
| 12.0 | 3.6 | 3.8 | 3.6 | 3.9 | 3.9 | 3.9 |
| 12.5 | 3.7 | 3.8 | 3.7 | 3.9 | 3.8 | 3.9 |
| 13.0 | 3.6 | 3.7 | 3.7 | 3.8 | 3.8 | 3.8 |
| 13.5 | 3.6 | 3.7 | 3.7 | 3.8 | 3.7 | 3.8 |
| 14.0 | 3.6 | 3.7 | 3.7 | 3.8 | 3.7 | 3.8 |
| 14.5 | 3.6 | 3.6 | 3.6 | 3.7 | 3.7 | 3.8 |
| 15.0 | 3.6 | 3.7 | 3.6 | 3.6 | 3.7 | 3.7 |
| 15.5 | 3.6 | 3.6 | 3.6 | 3.5 | 3.7 | 3.7 |
| 16.0 | 3.6 | 3.6 | 3.6 | 3.5 | 3.6 | 3.7 |
| 16.5 | 3.6 | 3.6 | 3.6 | 3.5 | 3.6 | 3.6 |
| 17.0 | 3.6 | 3.6 | 3.6 | 3.5 | 3.6 | 3.6 |
| 17.5 | 3.6 | 3.6 | 3.5 | 3.6 | 3.6 | |
| 18.0 | 3.6 | | 3.5 | 3.6 | 3.6 | |
| 18.5 | 3.6 | | 3.5 | 3.5 | 3.6 | |
| 19.0 | 3.6 | | | 3.5 | 3.7 | |
| 19.5 | 3.6 | | | | 3.7 | |

Results

The pilot-testing period lasted for longer than 14 months. This time period, of at least 14 months, was chosen as the timeframe to conduct the experiment as this was historically a typical length of time an extraction well could operate before requiring rehabilitation. The effectiveness of the anti-fouling measures over this period was based on the visual buildup of fouling in the well, long-term well performance, and the needs for well rehabilitation.

To evaluate the buildup of fouling in the well, pre-inerting-gas implementation conditions were compared to pilot-study conditions. Pumps from extraction wells TEW-09 and TEW-10 were both pulled at the end of the pilot testing period and visually inspected (FIG. 8A-8B). FIG. 8A at 802 shows the TEW-09 pump-motor assemblage after 14 months at the end of the pilot-testing period. The drop pipe, intake screen, and motor appeared free of biological and external mineral scaling. No cleaning or rinsing was done prior to taking the photograph. FIG. 8B at 804 shows the TEW-10 pump-motor assemblage at the end of the pilot-testing period. The pump, intake, and motor appeared free of biological fouling and external chemical precipitate and scaling. Minor fouling and scaling were observed on the drop pipe immediately above the pump. In both images, the components are free of biological fouling and external mineral or chemical precipitate and scaling. FIG. 8C at 806 shows the Well 235 pump-motor assemblage at the end of the pilot-testing period. The pump, intake, and motor were heavily covered in biological fouling and external chemical precipitate and scaling.

In addition, strainers, flow meters, and other valves that have historically shown evidence of fouling were checked periodically over the testing period. FIG. 9 shows images of components in TEW-09 effluent piping at various points in the pilot-testing period. Photographs in 900 show from left to right the strainer, globe valve, and flow meter with clear signs of fouling. Photographs in 902 show from left to right the strainer, globe valve, and globe valve seat with no signs of fouling after 3 weeks of gas treatment. Photographs in 904 show from left to right the strainer, globe valve components, check valve, and flow meter with no signs of fouling or scaling after 6 months of gas treatment. Photographs in 906 show the strainer, globe valve, check valve, and flow meter at the end of the pilot-testing period Long-term reductions in well performance due to fouling were evaluated. No fouling or reduction in pump performance was observed over the pilot period. Because little to no fouling occurred, additional chemical, physical, and/or heat treatments of the wells was not required.

Effectiveness in Creating Anoxic Environments

FIG. 10 at 1000 depicts results of dissolved oxygen in water between TEW-09 (1002) and TEW-10 (1004) (inerting gas treated wells) and KC99-235 (1006) and KC99-236 (1008) (chlorine treated wells). Dissolved oxygen profiles in the water were measured five times during the first six weeks of the pilot-testing period in inerting gas treated wells TEW-09 and TEW-10 and chlorine-treated control wells KC99-235 and KC99-236. After one week into the pilot-testing period, both gas-treated wells showed only a modest decrease from baseline in measured dissolved oxygen levels within the well (TEW-09–0.4% D.O. water; TEW-10–1.4% D.O. water) and oxic conditions were present in the upper water column (TEW-09 0-2 feet below water level; TEW-10 0–2.5 feet below water level) (FIG. 10). Following the week 1 measurements, the air-column purging methodology was evaluated, and modifications were made to improve replacement of atmospheric air in the well column air-space with inerting gas.

On week 3, well surface water conditions reached anoxic conditions (<0.5 mg/L, 5.41% D.O. water) in both wells TEW-09 and TEW-10 (FIG. 10). A reduction from 9.9% D.O. water to 4.4% D.O. water occurred in TEW-09, and a reduction of 8.8% D.O. water to 5.4% D.O. water occurred in TEW-10. Anoxic conditions continued to depth in each extraction well during week 4.

D.O. measurements in chlorine control wells KC99-235 and KC99-236 indicated no significant change during the same 4-week time period.

In TEW-09, a baseline percent D.O. air of 83% (where 100% equals 20.5% total oxygen content of air) was measured in the air column 15 feet below the top of casing. The D.O. air fell to 42.2% during week two and to 31% during week 3 after gas implementation. In TEW-10, a baseline percent D.O. air of 91.5% was measured in the air column 15 feet below the top of casing. The D.O. air fell to 51.4% during week two and 27.0% during week three after gas implementation. Note that during D.O. measurements, the inerting gas supply was turned off and the airtight seal was broken, likely allowing exchange and mixing of oxygen rich atmospheric air with well column airspace. The % D.O. air prior to breaking the seal was believed to be lower than the measured and reported value.

In summary, by three weeks, TEW-09 and TEW-10 had reached anoxic conditions and continued to maintain anoxic conditions within the full water column during the dissolved oxygen measurement period. Wells KC99-235 and KC99-236 did not have fully anoxic water conditions in the full water column during the dissolved oxygen measurement period.

Effectiveness of Nitrogen Versus Carbon Dioxide $N_2$ was used in well TEW-09, and $CO_2$ was used in well TEW-10. The $N_2$ well achieved a lower dissolved oxygen content and achieved this level sooner than $CO_2$ during the testing period. Approximately 3 weeks into testing, both wells had become anoxic, and both had eliminated new fouling by the end of the pilot test. Since both gases were effective against biological fouling and chemical precipitate and scaling, and the physical and chemical conditions in each well are different, no conclusion could be definitively drawn if one gas was superior in performance.

CONCLUSION

The pilot-testing period demonstrated that replacing atmospheric air with inerting gas in the air column reduces dissolved oxygen in the water column, thus inhibiting extraction well biological fouling and chemical precipitate and scaling, which benefits long term well performance, maintenance, and rehabilitation costs. Inspections of pump intake motor assemblages and vault peripheral parts indicated little to no new biological fouling or chemical precipitate or scaling during implementation, and the system required very little maintenance. The majority of inerting gas used by the system was during replacement of atmospheric air with inerting gas in the well column air-space, and aforementioned replacement was only required when the well seal was broken during measurements and inspection. Very little inerting gas was used in the daily operation of the wells.

The foregoing examples show the various embodiments in exemplary configurations; however, it should be appreciated that the various components may be configured in a variety of ways. As will be appreciated by those skilled in the art, the components of the various embodiments may be arranged at any location or locations so long as they do not affect the operation of the respective system.

It will be readily understood by those persons skilled in the art that the various embodiments are susceptible to broad utility and application. Many embodiments and adaptations other than those herein described, as well as many variations, modifications and equivalent arrangements, will be apparent from or reasonably suggested by the various embodiments and foregoing description thereof, without departing from the substance or scope of the various embodiments. For example, although the embodiments have been described herein in the context of a particular implementation in a particular environment for a particular purpose, those skilled in the art will recognize that its usefulness is not limited thereto and that the embodiments can be beneficially implemented in other related environments for similar purposes.

Accordingly, while the various embodiments have been described here in detail in relation to its exemplary embodiments, it is to be understood that this disclosure is only illustrative and exemplary of the various embodiments and is made to provide an enabling disclosure of the various embodiments. Accordingly, the foregoing disclosure is not intended to be construed or to limit the various embodiments or otherwise to exclude any other such embodiments, adaptations, variations, modifications, or equivalent arrangements.

What is claimed is:

1. A system, comprising:

a supply of inerting gas;

a gas supply line fluidly coupled to the supply of inerting gas that is fluidly coupled to a well through an air-tight seal, the gas supply line extending through the air-tight seal and into the well and terminating at a point above a fluid level in the well, wherein the supply of inerting gas is configured to displace existing atmospheric air in an air column of the well above the liquid level in the well and thereby create an anoxic environment that prevents chemical precipitation and scaling in the well;

a regulator positioned in-line on the gas supply line and configured to supply the inerting gas on demand to the well, the regulator being further configured to maintain a pressure of the inerting gas, in the well, greater than atmospheric pressure.

2. The system according to claim 1, wherein the inerting gas is selected from the group consisting of CO2, N2, He, Ar, combinations thereof, or mixtures thereof.

3. The system according to claim 1, wherein the inerting gas is an oxygen free gas.

4. The system according to claim 1, wherein the pressure of inerting gas maintained is 0.1 to 1 pound per square inch (psi) greater than atmospheric pressure.

5. The system according to claim 1, further comprising:

a relief valve located downstream of the supply of inerting gas and upstream of the well; and an oxygen sensor located proximal the relief valve and configured to measure oxygen content of gas displaced by the inerting gas in the well.

6. The system according to claim 1, wherein the inerting gas is configured to be supplied to the well such that an oxygen level in the air column is lowered to levels that prevent chemical precipitation and scaling in the well through displacement of the existing atmospheric air in the extraction well air column with the inerting gas.

7. The system according to claim 6, wherein a dissolved oxygen level of liquid in the well is lowered to 5.41% or less of atmospheric oxygen content.

8. The system according to claim 7, wherein the liquid is water.

9. The system according to claim 1, wherein the well is a ground water extraction well and the liquid in the well is water.

10. A method, comprising:

supplying an inerting gas, through a regulator, to an air column of a well;

purging the air column, using the inerting gas, to remove existing gas in the air column;

measuring an oxygen content of purged gas from the air column;

lowering the oxygen level in the air column to a level that prevents chemical precipitation, and scaling within the well; and maintaining a pressure, greater than atmospheric pressure in the air column, of the inerting gas to maintain the oxygen level at the level that inhibits the chemical precipitation and scaling within the well.

11. The method according to claim 10, wherein the inerting gas is selected from the group consisting of CO2, N2, He, Ar, combinations thereof, or mixtures thereof.

12. The method according to claim 10, wherein the inerting gas is an oxygen free gas.

13. The method according to claim 10, further comprising:

supplying the inerting gas on demand to account for pressure variations in the air column.

14. The method according to claim 10, wherein a dissolved oxygen level of liquid in the well is lowered to 5.41% or less of atmospheric oxygen content.

15. The method according to claim 10, wherein the purging comprises displacing gas within the air column with inerting gas using one of a relief valve or loosening of a seal or connection within the well.

16. The method according to claim 15, wherein an oxygen content of the displaced gas is measured using an oxygen sensor located proximal the relief valve.

17. The method according to claim 10, wherein the pressure of inerting gas maintained is 0.1 to 1 pound per square inch (psi) greater than atmospheric pressure.

18. The method according to claim 10, further comprising:

adjusting the pressure in response to fluid level changes in the well such that the pressure is decreased in response to an increase in a fluid level and increased in response to a decrease in the fluid level.

19. The method according to claim 10, wherein the well is a ground water extraction well.

20. The method according to claim 18, wherein the fluid is water.

* * * * *